US009708858B2

(12) United States Patent
King et al.

(10) Patent No.: US 9,708,858 B2
(45) Date of Patent: Jul. 18, 2017

(54) METHODS TO REPAIR WORN OR ERODED PDC CUTTERS, CUTTERS SO REPAIRED, AND USE OF REPAIRED PDC CUTTERS IN DRILL BITS OR OTHER TOOLS

(71) Applicant: Varel International Ind., L.P., Carrollton, TX (US)

(72) Inventors: William W. King, Houston, TX (US); Gary M. Thigpen, Houston, TX (US); Federico Bellin, Tomball, TX (US); Marvin Windsor Amundsen, Houston, TX (US); Charles Daniel Johnson, Porter, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 742 days.

(21) Appl. No.: 13/924,418

(22) Filed: Jun. 21, 2013

(65) Prior Publication Data

US 2013/0341102 A1 Dec. 26, 2013

Related U.S. Application Data

(60) Provisional application No. 61/663,205, filed on Jun. 22, 2012.

(51) Int. Cl.
*E21B 10/573* (2006.01)
*E21B 10/567* (2006.01)

(52) U.S. Cl.
CPC ..... *E21B 10/573* (2013.01); *E21B 10/567* (2013.01)

(58) Field of Classification Search
CPC ..... E21B 10/573; E21B 10/567
See application file for complete search history.

(56) References Cited

U.S. PATENT DOCUMENTS

| | | | |
|---|---|---|---|
| 5,609,286 | A | 3/1997 | Anthon |
| 5,957,365 | A | 9/1999 | Anthon |
| 8,863,864 | B1 | 10/2014 | Miess |
| 2005/0087371 | A1 | 4/2005 | Kembaiyan |
| 2006/0165973 | A1 | 7/2006 | Dumm et al. |

(Continued)

FOREIGN PATENT DOCUMENTS

| | | |
|---|---|---|
| CA | 1235049 | 4/1988 |
| EP | 0501447 | 9/1992 |

OTHER PUBLICATIONS

Copenheaver, Blain R., International Search Report and Written Opinion issued in PCT/US/2014/070952, 7 pages, completed on Feb. 20, 2015, mailed on Apr. 1, 2015.

(Continued)

*Primary Examiner* — Ryan J Walters

(57) ABSTRACT

A repaired polycrystalline diamond cutter and method for fabricating the same. The cutter includes a damaged substrate that includes at least one void therein, a polycrystalline diamond table coupled to the damaged substrate, and a build-up compound disposed within the voids formed about the damaged substrate. The damaged substrate and the build-up compound collectively form a full circumference. The method includes obtaining a damaged cutter that includes a polycrystalline diamond table coupled to a damaged substrate having at least one void formed therein, bonding a build-up compound within the at least one void and forming a processed PDC cutter, and removing a portion of the build-up compound from the processed PDC cutter and forming the repaired cutter.

12 Claims, 6 Drawing Sheets

(56) References Cited

U.S. PATENT DOCUMENTS

| | | | |
|---|---|---|---|
| 2008/0283305 | A1 | 11/2008 | Overstreet et al. |
| 2009/0032310 | A1 | 2/2009 | Stevens et al. |
| 2010/0276200 | A1 | 11/2010 | Schwefe et al. |
| 2010/0282519 | A1 | 11/2010 | Zhang et al. |
| 2011/0171414 | A1 | 7/2011 | Sreshta et al. |

OTHER PUBLICATIONS

Copenheaver, Blaine R, International Search Report and Written Opinion of the International Searching Authority for PCT/US2013/047162, Nov. 7, 2013, pp. 1-11.

Extended European Search Report dated Jun. 22, 2016 for app. # 13807170.9.

METHODS TO REPAIR WORN OR ERODED PDC CUTTERS, CUTTERS SO REPAIRED, AND USE OF REPAIRED PDC CUTTERS IN DRILL BITS OR OTHER TOOLS

CROSS-REFERENCE TO RELATED APPLICATIONS

The present application claims priority to U.S. Provisional Patent Application No. 61/663,205, entitled "Methods to Repair Worn or Eroded PDC Cutters, Cutters So Repaired, and Use of Repaired PDC Cutters In Drill Bits or Other Tools," filed Jun. 22, 2012, the disclosure of which is incorporated by reference herein.

BACKGROUND

This invention relates generally to polycrystalline diamond compact ("PDC") cutters. More particularly, this invention relates to methods to repair worn or eroded PDC cutters, the repaired cutters, and use of the repaired cutters in drill bits and/or other tools.

FIG. 1 shows a perspective view of a drill bit 100 in accordance with the prior art. Referring to FIG. 1, the drill bit 100 includes a bit body 110 that is coupled to a shank 115. The shank 115 includes a threaded connection 116 at one end 120. The threaded connection 116 couples to a drill string (not shown) or some other equipment that is coupled to the drill string. The threaded connection 116 is shown to be positioned on the exterior surface of the one end 120. This positioning assumes that the drill bit 100 is coupled to a corresponding threaded connection located on the interior surface of a drill string (not shown). However, the threaded connection 116 at the one end 120 is alternatively positioned on the interior surface of the one end 120 if the corresponding threaded connection of the drill string (not shown) is positioned on its exterior surface in other exemplary embodiments. A bore (not shown) is formed longitudinally through the shank 115 and the bit body 110 for communicating drilling fluid from within the drill string to a drill bit face 111 via one or more nozzles 114 during drilling operations.

The bit body 110 includes a plurality of blades 130 extending from the drill bit face 111 of the bit body 110 towards the threaded connection 116. The drill bit face 111 is positioned at one end of the bit body 110 furthest away from the shank 115. The plurality of blades 130 form the cutting surface of the drill bit 100, which may be an infiltrated matrix drill bit. One or more of these plurality of blades 130 are either coupled to the bit body 110 or are integrally formed with the bit body 110. A junk slot 122 is formed between each consecutive blade 130, which allows for cuttings and drilling fluid to return to the surface of the wellbore (not shown) once the drilling fluid is discharged from the nozzles 114. A plurality of cutters 140 are coupled to each of the blades 130 within the sockets 180 formed therein, and extend outwardly from the surface of the blades 130 to cut through earth formations when the drill bit 100 is rotated during drilling. One type of cutter 140 used within the drill bit 100 is a PDC cutter; however other types of cutters are contemplated as being used within the drill bit 100. The cutters 140 and portions of the bit body 110 deform the earth formation by scraping and/or shearing. The cutters 140 and portions of the bit body 110 are subjected to extreme forces and stresses during drilling which causes surface of the cutters 140 and the bit body 110 to wear. Eventually, the surfaces of the cutters 140 and the bit body 110 wear to an extent that the drill bit 100 is no longer useful for drilling and is either repaired or discarded depending upon the type of damage and/or the extent of the damage. Although one embodiment of the drill bit has been described, other drill bit embodiments or other downhole tools that use PDC cutters, which are known to people having ordinary skill in the art, are applicable to exemplary embodiments of the present invention.

FIGS. 2A and 2B show various views of a PDC (Polycrystalline Diamond Compact) cutter 140 in accordance with the prior art. FIG. 2A is a perspective view of the PDC cutter 140 in accordance with the prior art. FIG. 2B is a side view of the PDC cutter 140 in accordance with the prior art. These PDC (Polycrystalline Diamond Compact) cutters 140 are commonly used in oil and gas drill bits 100 (FIG. 1), and in other downhole tools. Referring to FIGS. 2A and 2B, the PDC cutters 140 provide a superhard material layer 210, such as a diamond table, which has been fused at high pressure and high temperature ("HPHT") to a metal backing, or substrate 220, typically tungsten carbide. The PCD cutting table 210, or diamond table, is about one hundred thousandths of an inch (2.5 millimeters) thick; however, the thickness is variable depending upon the application in which the PCD cutting table 210 is to be used. The substrate 220 includes a top surface 222, a bottom surface 224, and a substrate outer wall 226 that extends from the circumference of the top surface 222 to the circumference of the bottom surface 224. The PCD cutting table 210 includes a cutting surface 212, an opposing surface 214, and a PCD cutting table outer wall 216. The PCD cutting table outer wall 216 is substantially perpendicular to the plane of the cutting surface 212 and extends from the outer circumference of the cutting surface 212 to the circumference of the opposing surface 114. The opposing surface 214 of the PCD cutting table 210 is coupled to the top surface 222 of the substrate 220. According to some exemplary embodiments, the cutting surface 212 is formed with at least one bevel (not shown) along the circumference of the cutting surface 212.

Upon coupling the PCD cutting table 210 to the substrate 220, the cutting surface 212 of the PCD cutting table 210 is substantially parallel to the substrate's bottom surface 224. Additionally, the PDC cutter 140 has been illustrated as having a right circular cylindrical shape; however, the PDC cutter 140 is shaped into other geometric or non-geometric shapes in other examples. In certain examples, the opposing surface 214 and the top surface 222 are substantially planar; however, the opposing surface 214 and/or the top surface 222 is non-planar in other examples.

The PDC cutters 140 are expensive to manufacture and constitute a significant portion of the cost of PDC mounted bits 100 (FIG. 1) and tools. PDC cutters 140 are typically brazed into sockets 180 (FIG. 1) formed in the body of a bit 100 (FIG. 1) or tool. This braze joint is frequently the "weak link" in the durability of the tool. A good braze joint requires a very narrow clearance between the socket 180 (FIG. 1) and the PDC cutter 140 that is being brazed into it. A clearance in the range of 0.002 inches or less is desired between the socket 180 (FIG. 1) and the PDC cutter 140 when positioned within the socket 180 (FIG. 1) prior to applying the braze material. A looser fit, i.e. a large clearance, can weaken the braze joint and result in the loss of the PDC cutter 140 in application, thereby shortening the useful life of the bit 100 (FIG. 1) or tool.

FIGS. 3A-3E show several views of damaged PDC cutters 300, 310, 320, 330 in accordance with the prior art. FIG. 3A is a perspective view of a damaged PDC cutter 300 that is heavily worn and eroded in accordance with the prior art.

FIG. 3B is a perspective view of a damaged PDC cutter 310 that is slightly eroded in accordance with the prior art. FIG. 3C is a perspective view of a damaged PDC cutter 320 that is heavily eroded in accordance with the prior art. FIG. 3D is a perspective view of a damaged PDC cutter 330 that is eroded in accordance with the prior art. FIG. 3E is a side view of the damaged PDC cutter 330 in accordance with the prior art. Referring to FIGS. 3A-3E, some damaged PDC cutters 310 that have been slightly worn or eroded have historically been rotated to a "full cylinder" section of the tungsten carbide substrate 220 to be reused while orienting a virgin diamond cutting edge towards the formation. If the damaged PDC cutters 300, 320, 330 are too heavily worn or eroded, such as that shown in FIGS. 3A, 3C, 3D, and 3E, the damaged cutters 300, 320, 330 typically are discarded as scrap. In some instances the scrapped cutters 300, 320, 330 have been reclaimed by using wire EDM to cut out a smaller diameter cylinder to make a recovered smaller diameter cutter (not shown). This method does not allow for the direct reuse of the cutter in a similar bit or tool, but instead, the recovered smaller diameter cutter must be deployed in a tool that can economically accommodate the smaller diameter cutter, i.e. has a pocket dimensioned to fit and use the smaller diameter cutter.

The decision as to whether or not a worn or eroded cutter is reused, rotated, or discarded has been based in part on the condition of the remaining tungsten carbide substrate. The criterion depends on the amount of full cylinder substrate remaining. If an insufficient amount of full cylinder substrate remains to allow for a strong braze joint when oriented with a fresh diamond edge towards the formation, then the cutter is typically scrapped or reprocessed as described above.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

This invention relates generally to PDC cutters. More particularly, this invention relates to methods to repair worn or eroded PDC cutters, the repaired cutters, and use of the repaired cutters in drill bits and/or other tools. Although the description provided below is related to a PDC cutter, exemplary embodiments of the invention relate to any cutter having a substrate and a superhard material layer, such as a diamond table, attached thereto.

Figure 4:
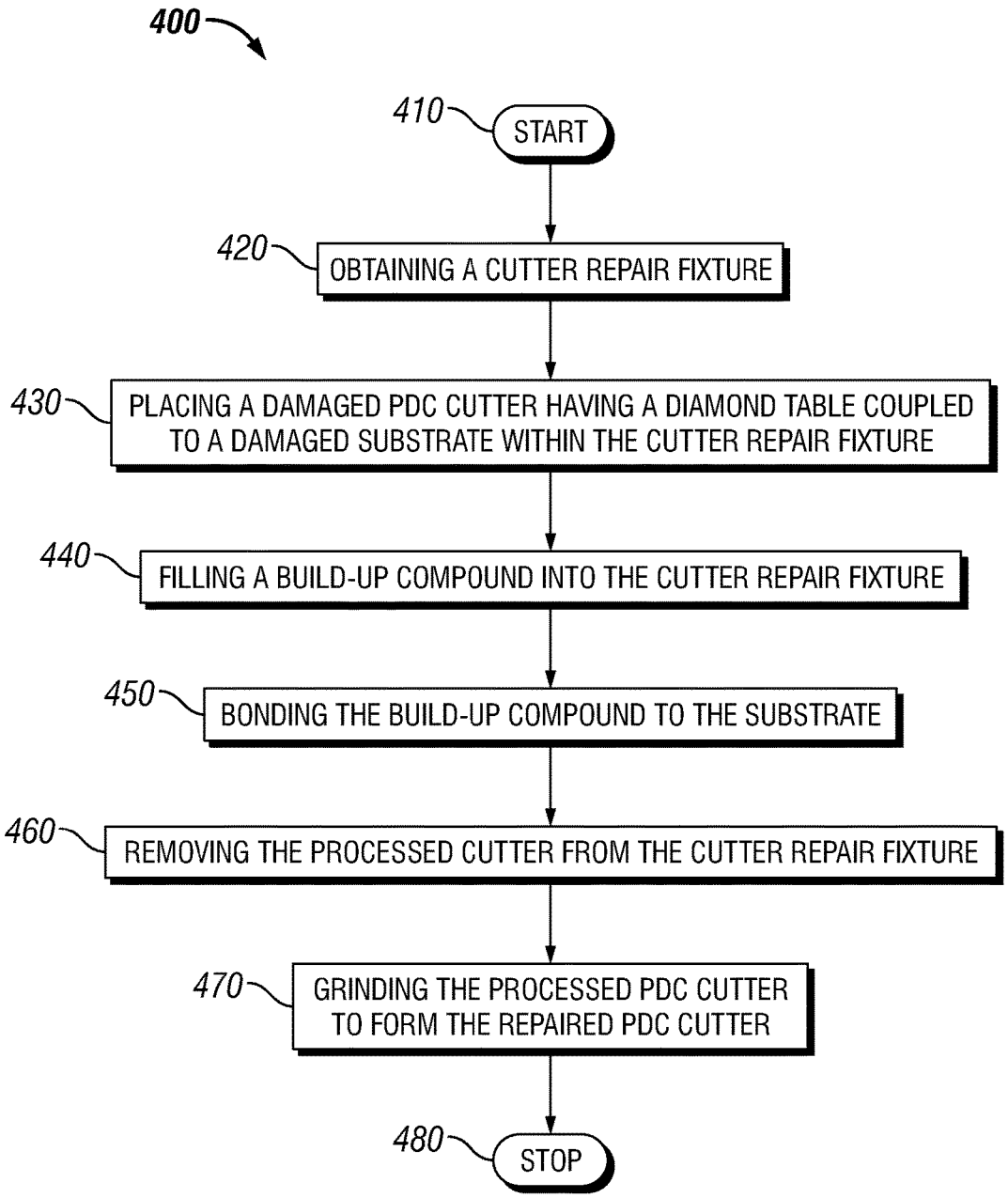
FIG. 4 is a flow chart illustrating a method for repairing a damaged PDC cutter, such as the PDC cutters of FIGS. 3A-3E, in accordance with an exemplary embodiment of the present invention.
Figure 5:
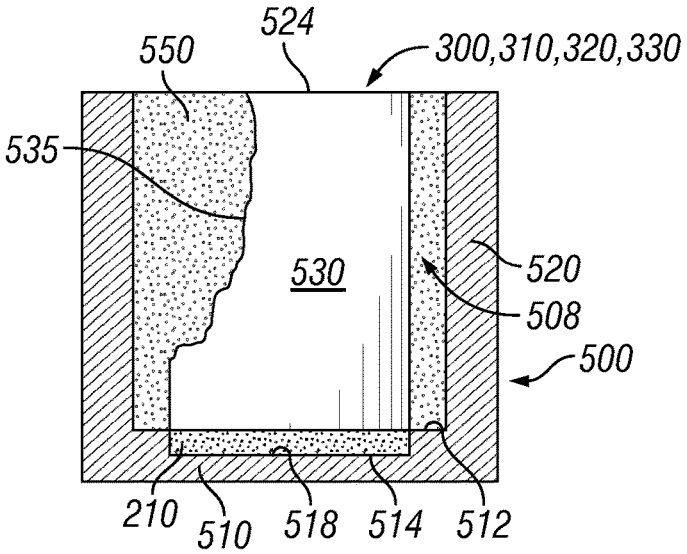
FIG. 5 is a cross-sectional view of a cutter repair fixture that has a damaged PDC cutter of FIGS. 3A-3E and a build-up compound disposed therein in accordance with an exemplary embodiment of the present invention.

FIG. 4 is a flow chart illustrating a method 400 for repairing a damaged PDC cutter 300, 310, 320, such as PDC cutters 300, 310, 320 (FIGS. 3A-3E), in accordance with an exemplary embodiment of the present invention. FIG. 5 is a cross-sectional view of a cutter repair fixture 500 that has a damaged PDC cutter 300, 310, 320, 330 and a build-up compound 550 disposed therein in accordance with an exemplary embodiment of the present invention. Referring to FIGS. 4 and 5, the method 400 and the associated components for performing method 400 are illustrated and described herein. Method 400 starts at step 410. After step 410, a cutter repair fixture 500 is obtained at step 420.

Figure 2A:
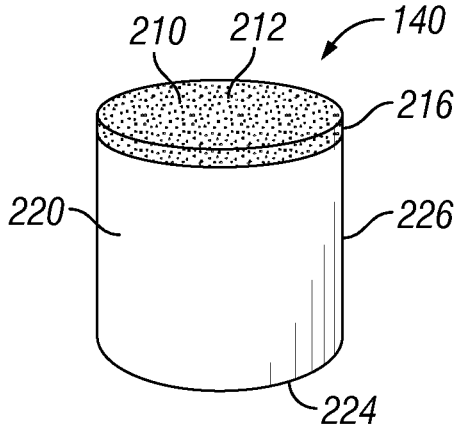
FIG. 2A (Prior Art)
FIGS. 2A and 2B show various views of a PDC cutter in accordance with the prior art.
Figure 2B:
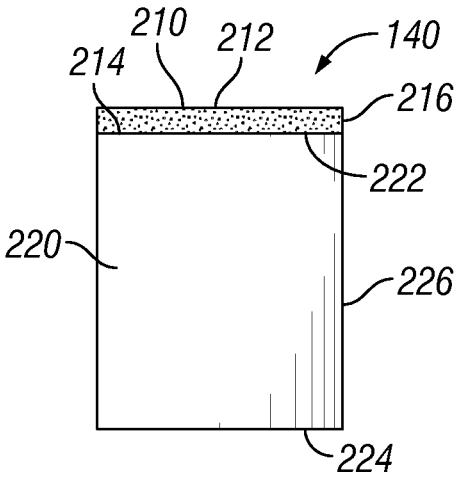
FIG. 2B (Prior Art)
Figure 3A:
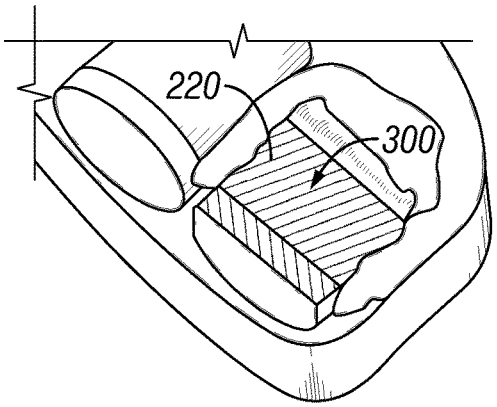
FIG. 3A (Prior Art)
FIGS. 3A-3E show several perspective views of damaged PDC cutters in accordance with the prior art.
Figure 3B:
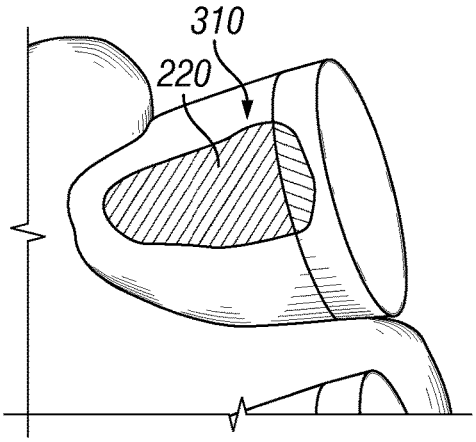
FIG. 3B (Prior Art)
Figure 3C:
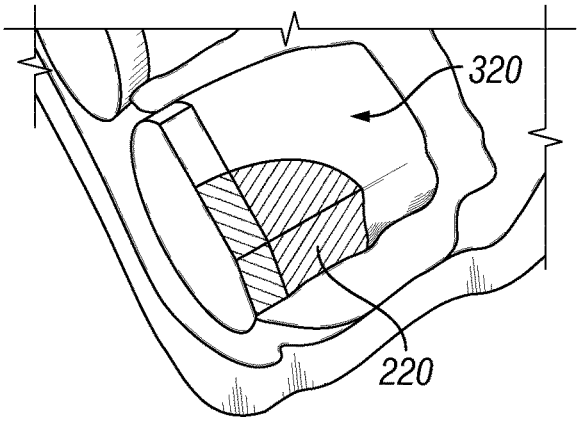
FIG. 3C (Prior Art)
Figure 3D:
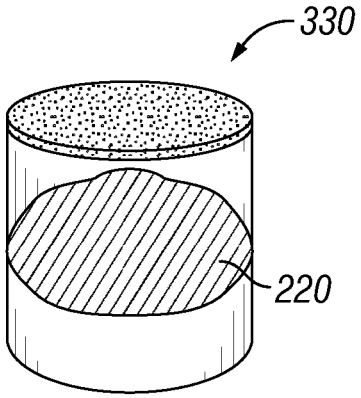
FIG. 3D (Prior Art)
Figure 3E:
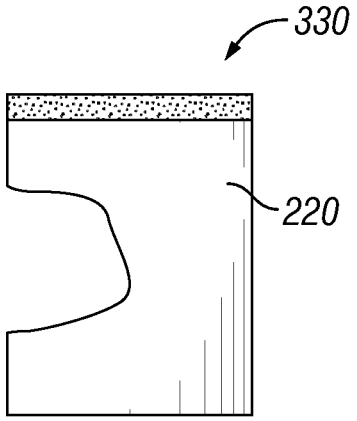
FIG. 3E (Prior Art)

According to some exemplary embodiments, the cutter repair fixture 500 includes a base 510 and at least one sidewall 520 extending substantially orthogonally away from the base 510, thereby forming a first cavity 508 therein. According to certain exemplary embodiments, the base 510 and the at least one sidewall 520 are formed as a single component; however, in other exemplary embodiments, the base 510 and the sidewalls 520 are formed separately and thereafter coupled together, such as by being threadedly coupled together. The first cavity 508 forms a substantially cylindrical shape; however, in some alternative exemplary embodiments, the first cavity 508 forms a different geometric or non-geometric shape, such as a tubular shape having a square, rectangular, triangular, or other non-geometric cross-sectional shape. The height of the first cavity 508 is similar to, or greater than, the height of the substrate 530, which is similar to substrate 220 (FIGS. 2A and 2B) and is therefore not described again in detail herein for the sake of brevity, and the circumference of the first cavity 508 is larger than the circumference of the substrate 530.

According to some exemplary embodiments, the base 510 includes an interior surface 512 that is non-planar and defines a portion of the first cavity 508. The interior surface 512 includes a second cavity 514 formed therein extending inwardly from a portion of the interior surface 512 of the base 510. The second cavity 514 is fluidly coupled to the first cavity 508. According to certain exemplary embodiments, the second cavity 514 is cylindrically shaped and is dimensioned to receive the diamond table 210 of the damaged PDC cutter 300, 310, 320. Thus, the height of the second cavity 514 is similar to the thickness of the diamond table 210 and the circumference of the second cavity 514 is similar to, but slightly larger than, the circumference of the diamond table 210. In certain exemplary embodiments, the diameter of the first cavity 508 is slightly larger than the diameter of the second cavity 514.

The cutter repair fixture 500 is fabricated using a suitable material capable of withstanding temperatures used in the repair method 400. The temperatures used in the repair method 400 are dependent upon the type of build-up compound 550 that is used and the melting temperatures of these build-up compounds 550. For example, the cutter repair fixture 500 is exposed to temperatures reaching up to about 700 degrees Celsius in some exemplary embodiments, while in other exemplary embodiments, the cutter repair fixture 500 is exposed to temperatures reaching greater than 700 degrees Celsius. In exemplary embodiments where the diamond table 210 is exposed to temperatures of about 700 degrees Celsius or greater, at least the base 510 of the cutter repair fixture 500, and the sidewalls 520 in some exemplary embodiments, is fabricated using a heat sink material, such as aluminum or some other metal or metal alloy, that has a high heat transfer coefficient to keep the diamond table 210 at a temperature below 750 degrees Celsius. Further, the base 510, and optionally the sidewalls 520, are fabricated to include fins (not shown) pursuant to some exemplary embodiments. According to certain alternative exemplary embodiments, a heat sink (not shown), which optionally includes fins, is thermally coupled to at least the base 510 of the cutter repair fixture 500 to keep the diamond table 210 at a temperature below 750 degrees Celsius. The heat sink is optionally used even if the diamond table 210 is exposed to only temperatures less than 700 degrees Celsius. Although one example of a cutter repair fixture has been described herein, alternative types of cutter repair fixtures that are obvious variants to the cutter repair fixture 500 can be used in alternative exemplary embodiments.

After step 420, a damaged PDC cutter 300, 310, 320, 330 having a diamond table 210 coupled to a damaged substrate 530 is placed within the cutter repair fixture 500 at step 430. The damaged PDC cutter 300, 310, 320, 330 is typically worn or eroded in at least the substrate 530. The diamond table 210 is oriented to be positioned and set within the second cavity 514, while the damaged substrate 530 is positioned within the first cavity 508. According to some exemplary embodiments, the damaged PDC cutter 300, 310, 320, 330 is cleaned prior to being placed within the cutter repair fixture 500.

Figure 1:
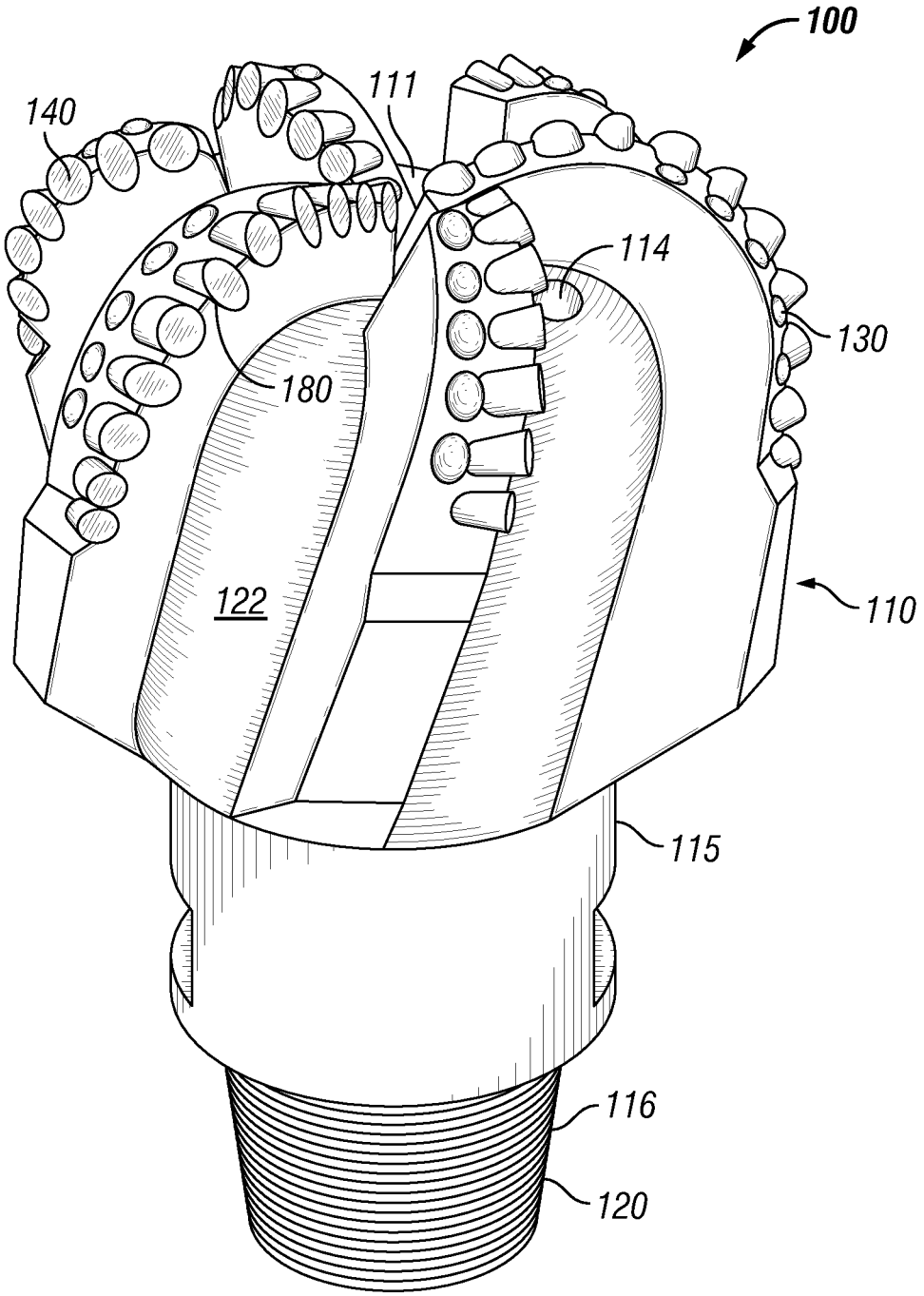
FIG. 1 (Prior Art)
FIG. 1 shows a perspective view of a drill bit in accordance with the prior art.

After step 430, the buildup compound 550 is filled into the cutter repair fixture 500 at step 440. The build-up compound 550 is a material capable of being bonded to the substrate 530, which for example is fabricated from tungsten carbide or tungsten carbide matrix. The build-up compound 550 is any element or combination of elements with a melting point higher than the liquidus temperature of the braze filler material that is used to braze the repaired PDC cutter 600 (FIGS. 6A and 6B) into a cutter pocket, or socket 180 (FIG. 1), formed in the bit 100 (FIG. 1). An example of the build-up compound 550 includes a metallic material that includes at least one of a silver, silver compound, compound nickel, chrome, boron, and silicon mix. According to some exemplary embodiments, the build-up compound 550 includes an amount of tungsten carbide. In certain alternative exemplary embodiments, several alternative material mixes are used for the buildup compound 550, as is known or become known to people having ordinary skill in the art having the benefit of the present disclosure.

After step 440, the build-up compound 550 is bonded to the substrate 530 at step 450. According to some exemplary embodiments, the cutter repair fixture 500 with the damaged PDC cutter 300, 310, 320, 330 and the build-up compound undergoes a microwave sintering process to bond the build-up compound 550 to the substrate 530 and fill the void in the worn or eroded PDC cutter 300, 310, 320, 330. Thus, a fresh thickness of metallic material, or buildup compound 550, is applied, or coupled, all around the outer circumference of the substrate 530 of the previously used and damaged PDC cutter 300, 310, 320, 330. Alternatively, according to other exemplary embodiments, other types of coupling processes, such as a spark sintering process or other known sintering processes having the benefit of the present disclosure, are used to bond the build-up compound 550 to the substrate 530 and form the processed PDC cutter within the cutter repair fixture 500. According to certain exemplary embodiments, the processed PDC cutter has a substrate with a diameter larger than the diameter of the associated diamond table 210. For example, the diameter of the substrate of the processed PDC cutter is substantially the same as the diameter of the first cavity 508.

After step 450 where the build-up compound 550 has coupled around the used PDC cutter 300, 310, 320, 330, the processed PDC cutter is removed from the cutter repair fixture 500 at step 460. According to some exemplary embodiments, the cutter repair fixture 500 is undamaged and reusable after the processed PDC cutter is removed from the cutter repair fixture 500. In other exemplary embodiments, cutter repair fixture 500 is damaged and not reusable once the processed PDC cutter is removed from the cutter repair fixture 500.

After step 460, the processed PDC cutter is grounded to form the repaired PDC cutter 600 (FIGS. 6A and 6B) at step 470. According to some exemplary embodiments, the processed PDC cutter is placed within an OD grinder (not shown) and OD grounded, or grounded around its outer diameter, to form the repaired PDC cutter 600 (FIGS. 6A and 6B), which is at or near the same outer diameter as the outer diameter of the PDC cutter prior to being damaged. When an OD grinder is used, a pressure cup, a partial pressure cup, or a shallow collet is used to hold the diamond cutting surface 518 of the cutter and a live center is optionally used to apply pressure to the bottom surface 524 of the cutter to hold it in place during the grinding operation. Optionally, the bottom surface 524, or back face, of the substrate 530 is ground flat and substantially parallel to the diamond cutting surface 518. However, in other exemplary embodiments, the bottom surface 524 of the substrate 530 is not ground flat and/or is not substantially parallel to the diamond cutting surface 518. Alternatively, in other exemplary embodiments, the processed PDC cutter is placed within a centerless grinder (not shown) or other appropriate shaping tool to return the outer diameter of processed PDC cutter to a value matching or close to matching the original diameter of the PDC cutter, thereby forming the repaired PDC cutter 600 (FIGS. 6A and 6B).

Figure 6A:
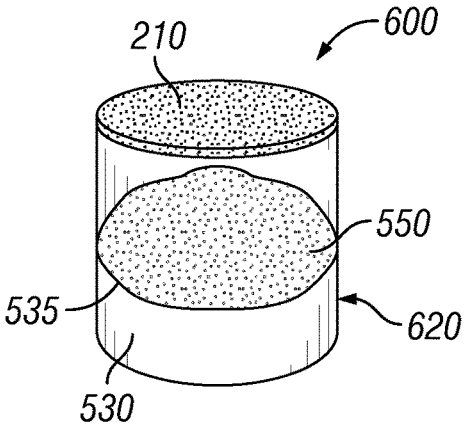
FIGS. 6A and 6B show various views of a repaired PDC cutter in accordance with an exemplary embodiment of the present invention.
Figure 6B:
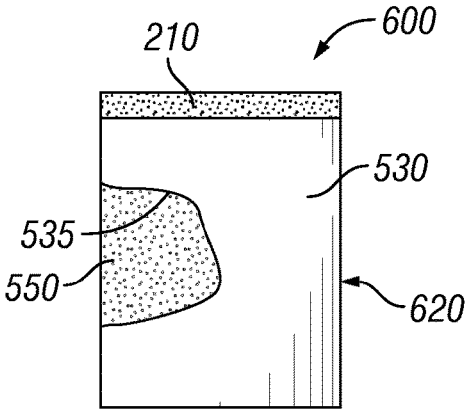

FIGS. 6A and 6B show various views of the repaired PDC cutter 600 in accordance with an exemplary embodiment of the present invention. The repaired PDC cutter 600 is similar to PDC cutter 140 except that the diamond table 210 is bonded to a repaired substrate 620. According to certain exemplary embodiments, the repaired substrate 620 includes a damaged substrate 530 having one or more voids 535 therein and the build-up compound 550 bonded to the damaged substrate 530 and disposed within the one or more voids such that the damaged substrate 530 and the build-up compound 550 within the repaired substrate 620 collectively form a full cylindrical shape having a diameter equivalent to the diameter of the diamond table 210 when the diamond table 210 has not been damaged, or equivalent to the diameter of the original substrate prior to being damaged. According to certain exemplary embodiments, the circumference of both the diamond table 210 and the repaired substrate 620 are reduced from the original diameters such that the resulting substrate still includes some build-up compound 550.

After step 470, the repair method 400 stops at step 480. Although method 400 has been depicted herein with respect to certain steps, these steps are not limited to the order in which they are presented, but instead, may be performed in a different order in other exemplary embodiments. Further, some steps may be separated into additional steps. Alternatively, some steps may be combined into fewer steps. Furthermore, some steps may be performed in an entirely different manner than the example provided herein and are understood to be included within the exemplary embodiments.

In an alternative exemplary embodiment, the buildup compound 550 is bonded to the damaged PDC cutter 300, 310, 320, 330 via welding to fill in the voided area 535 in the damaged substrate 530. The welding method includes, but is not limited to, laser, plasma transfer arc, thermal plasma spray, or any other appropriate method known to people having ordinary skill in the art having the benefit of the present disclosure. According to the thermal plasma spray method, the buildup compound 550 is welded to the damaged PDC cutter 300, 310, 320, 330 to fill in the voided area 535 in the damaged substrate 530. A copper paste (not shown) is applied over the area that was sprayed with the buildup compound 550 according to certain exemplary embodiments. A flash heating is then performed with an induction unit (not shown), for example, which melts the copper and allows it to infiltrate into the buildup compound 550 that has filled the voided area 535, thereby forming the processed PDC cutter. This infiltration strengthens the bonding between the buildup compound 550 and the damaged substrate 530 of the damaged PDC cutter. Subsequently, a grinder or some other equipment, as previously mentioned, is used to grind the processed PDC cutter to the predetermined diameter, thereby forming the repaired PDC cutter 600. This predetermined diameter has been described above and is not described again for the sake of brevity. During the welding process, a heat sink is optionally placed in thermal contact with the diamond table 210, thereby maintaining the temperature of the diamond table to less than 700° C. The heat sink is a plate or a plate with fins according to some exemplary embodiments. Alternatively, the heat sink is a different shape. The heat sink is fabricated from copper, aluminum, or some other metal or metal alloy having a sufficient thermal coefficient capable of maintaining the temperature of the diamond table to less than 700° C.

According to either of the exemplary embodiments described above and/or any other alternative exemplary embodiments known to people having ordinary skill in the art having the benefit of the present disclosure, one or more additional processes described below is included therein. One process includes using a 3-D scanner (not shown) to scan the damage PDC cutter 300, 310, 320, 330 to determine the minimum amount, or volume, of build-up compound 550 needed and where the build-up compound 550 is needed so that excess build-up compound 550 is not used. Determining the minimum amount, or volume, of build-up compound 550 needed reduces costs by not wasting the build-up compound 550. Hence, less build-up compound 550 is removed during the grinding step. Another process includes dipping at least the damaged portion, or voided area 535, of the damaged PDC cutter 300, 310, 320, 330 into melted cobalt, thereby having the cobalt provide a coating along the damaged, or voided area 535. The coated PDC cutter is placed in the cutter repair fixture 500, or a crucible, fabricated from either ceramic, graphite, or some other suitable material. The build-up compound 550 is packed into the cutter repair fixture 500, or the crucible, and into the damaged portion, or voided area 535, to reform the damaged PDC cutter 300, 310, 320, 330 into the dimensions of the repaired PDC cutter 600. Induction heating is applied onto the processed PDC cutter, thereby forming the repaired PDC cutter 600. The cobalt intermediate coating facilitates the coupling of the build-up compound 550 to the damaged substrate 530 of the damaged PDC cutter 300, 310, 320, 330. In another process, the temperature of the diamond layer 210 is maintained to be less than 700° C. according to some exemplary embodiments. If the temperature of the diamond layer 210 reached 700° C. or higher, the diamond layer 210 has chances to be damaged. For example, graphitization can occur at these elevated temperatures. Thus, in some exemplary embodiments, the build-up compound 550 used has a melting temperature that is less than 700° C., or is at a temperature that prevents the diamond layer 210 from reaching above 700° C. during the repair method 400, or during any of the other alternative exemplary embodiments. The welding process is controlled to ensure that the temperature of the diamond layer 210 remains below 700° C.

However, in certain exemplary embodiments, the cutter repair fixture 500, as previously mentioned, includes a heat sink (not shown) adjacent to the diamond table 210 to keep the polycrystalline diamond layer 210 from overheating and suffering thermal damage during the repair operation. This heat sink is included when the melting temperature of the build-up compound 550 is equal to or higher than 700° C. and is optionally included when the melting temperature of the build-up compound 550 is less than 700° C.

The methods for repairing cutters, as described above, are performed on PDC cutters, whether they have been pre-processed, post-processed, or not processed at all. Some processing examples, which are not meant to be limiting, include leaching, annealing, cryogenic treatment, chemical vapor deposition, or creating a new or larger sized chamfer on the diamond table 210, which are known to people having ordinary skill in the art. Leaching includes face leaching, side leaching, bevel leaching, and/or double bevel leaching, which are terms known to people having ordinary skill in the art. Masking may also be used during the processing. Thus, for example, a PDC cutter that has previously been leached and damaged during use is subjected to any of the repair methods described above. This is an example of repairing a PDC cutter that has been pre-processed. In another example, a PDC cutter that has not been pre-processed and damaged during use is subjected to any of the repair methods described above and then subsequently leached. This is an example of post-processing a repaired PDC cutter.

Exemplary embodiments allow for a more complete use of expensive PDC components, which includes the re-use of damaged PDC components, in drill bits and tools. These exemplary embodiments facilitate in reducing costs and enhancing the retention of cutters that are reused after wear or erosion. These exemplary embodiments offer a more far superior solution than scrapping or wire EDM cutting cutters. Cutters are now salvageable by using the exemplary embodiments, as described above.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims.

It is therefore, contemplated that the claims will cover any such modifications or embodiments that fall within the scope of the invention.

What is claimed is:

1. A method for repairing a damaged cutter, the method comprising:

obtaining a damaged polycrystalline diamond cutter comprising:

a damaged substrate defining at least one void therein;

a polycrystalline diamond (PCD) table coupled to the damaged substrate and formed from a polycrystalline diamond structure defining a plurality of interstitial spaces therebetween and a catalyst material disposed within one or more of the interstitial spaces;

placing the damaged substrate and the PCD table coupled thereto within a cutter repair fixture;

filling the cutter repair fixture with a build-up compound;

bonding the build-up compound with the damaged substrate, thereby forming a processed substrate still having the PCD table coupled thereto;

removing the processed cutter substrate and the PCD table coupled thereto from the cutter repair fixture; and removing a portion of the build-up compound from the processed substrate, thereby forming a repaired substrate still having the PCD table coupled thereto, wherein a diameter and a shape of the repaired substrate matches a diameter and shape of the damaged substrate prior to being damaged.

2. The method of claim 1, wherein the cutter repair fixture comprises:

a base having an interior surface; and at least one sidewall extending orthogonally away from the base, wherein the base and the at least one sidewall collectively define a first cavity.

3. The method of claim 2, wherein the base comprises a second cavity extending inwardly from the interior surface, the second cavity being fluidly coupled to the first cavity and dimensioned to receive the polycrystalline diamond table of the damaged polycrystalline diamond cutter.

4. The method of claim 3, wherein a height of the second cavity is similar to the depth of the polycrystalline diamond table of the damaged polycrystalline diamond cutter.

5. The method of claim 3, wherein placing the damaged substrate and the PCD table coupled thereto within a cutter repair fixture comprises:

disposing the polycrystalline diamond table of the damaged polycrystalline diamond cutter within the second cavity; and disposing the damaged substrate within the first cavity.

6. The method of claim 2, further comprising a heat sink thermally coupled to the base.

7. The method of claim 1, wherein the build-up compound comprises a metallic material, the metallic material comprising at least one of a silver, silver compound, compound nickel, chrome, boron, and silicon mix.

8. The method of claim 1, wherein the build-up compound comprises an amount of tungsten carbide.

9. The method of claim 1, wherein the build-up compound comprises a melting temperature less than 700° C.

10. The method of claim 1, wherein bonding the build-up compound with the damaged substrate, thereby forming a processed substrate comprises at least one of a microwave sintering process and a spark sintering process.

11. The method of claim 1, wherein bonding the build-up compound with the damaged substrate, thereby forming a processed substrate comprises maintaining the temperature of the polycrystalline diamond table of the damaged polycrystalline diamond cutter less than 700° C.

12. The method of claim 1, further comprising coating at least a portion of the damaged substrate with melted cobalt.

* * * * *